United States Patent [19]

Hawkins

[11] Patent Number: 4,966,310

[45] Date of Patent: Oct. 30, 1990

[54] COLLAPSIBLE STORAGE CONTAINER AND METHOD FOR STORING MATTER

[76] Inventor: Gerald P. Hawkins, 6987 Robb St., Arvada, Colo. 80004

[21] Appl. No.: 278,592

[22] Filed: Dec. 1, 1988

[51] Int. Cl.[5] ..... B65D 35/56

[52] U.S. Cl. ..... 222/105; 222/143; 222/190; 222/630; 222/394; 383/19; 220/5 A; 141/7; 141/10

[58] Field of Search ..... 141/7, 10, 59; 220/5 A, 220/6, 9.1, 9.2; 383/119, 32, 18, 19; 222/105, 143, 181, 204, 394, 630, 190

[56] References Cited

U.S. PATENT DOCUMENTS

| | | | |
|---|---|---|---|
| 2,783,786 | 3/1957 | Carter | 383/19 |
| 2,811,178 | 10/1957 | Cunningham | 383/19 |
| 3,344,831 | 7/1964 | Brackett | 150/0.5 |
| 3,372,725 | 3/1968 | Voorhees | 222/105 |
| 3,374,916 | 3/1968 | Herff | 220/5 A |
| 3,374,929 | 3/1968 | Silverskiold | 222/181 |
| 3,545,641 | 12/1969 | Olson | 222/143 |
| 3,616,957 | 5/1969 | Patton | 220/1.5 |
| 3,774,812 | 11/1973 | Lemelson | 383/19 |
| 3,814,290 | 6/1974 | Gerhard | 220/5 A |
| 3,840,135 | 10/1974 | Bridge | 214/621 |
| 3,868,042 | 2/1975 | Bodenheimer | 220/63 R |
| 3,912,103 | 10/1975 | Gerhard | 220/5 A |
| 3,980,196 | 9/1976 | Paulyson et al. | 220/1.5 |
| 4,054,226 | 10/1977 | Bjelland et al. | 220/63 R |
| 4,155,469 | 5/1979 | Cole | 222/105 |
| 4,557,400 | 12/1985 | Clarke | 222/105 |

FOREIGN PATENT DOCUMENTS

| | | | |
|---|---|---|---|
| 96283 | 9/1963 | Denmark | 220/9.2 |
| 769232 | 3/1957 | United Kingdom | 141/59 |

*Primary Examiner*—H. Grant Skaggs
*Attorney, Agent, or Firm*—Brian D. Smith

[57] ABSTRACT

A sealable, collapsible storage module for storing and shipping matter such as grain and plastic resins is disclosed. The module includes a body having a bottom portion and a flexible, collapsible upper portion. The flexible, collapsible upper portion is sealed to the bottom portion to define a sealable storage chamber for storing matter. The body also defines at least one sealable port in communication with the storage chamber through which matter is conveyed. The module also includes a plurality of internal support lines extending across the inside of the storage chamber wherein each support line is attached at its ends to opposing sides of the upper body portion. The plurality of support lines provides internal support for the upper portion to prevent it from rupturing when it is filled with matter such as grain.

13 Claims, 6 Drawing Sheets

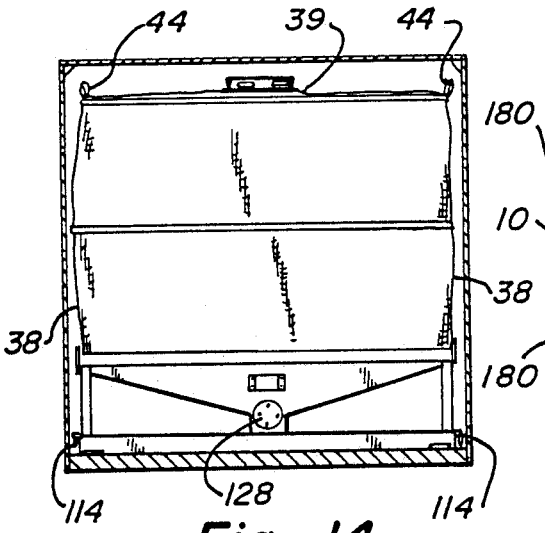
Fig_14
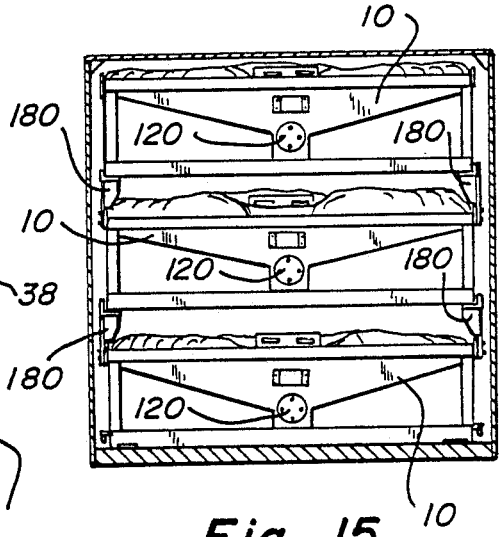
Fig_15
Fig_16
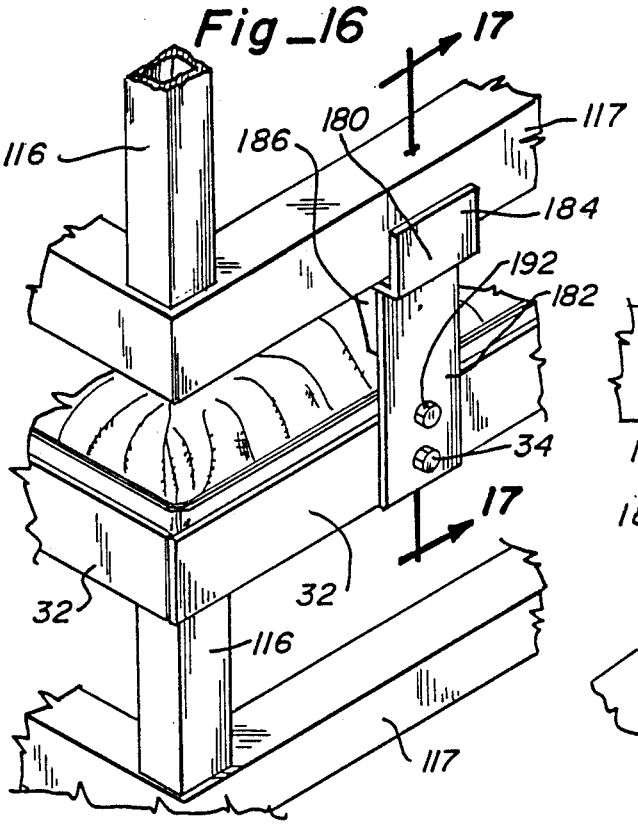
Fig_17
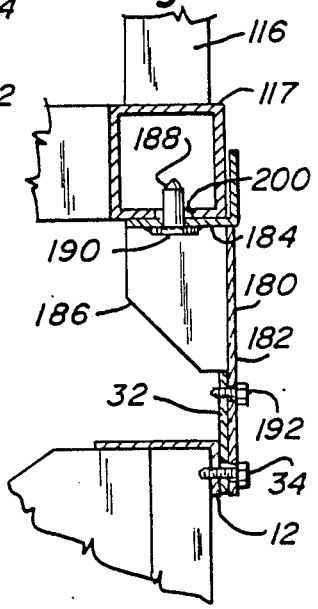

COLLAPSIBLE STORAGE CONTAINER AND METHOD FOR STORING MATTER

TECHNICAL FIELD

The present invention relates generally to shipping containers and, more particularly, to sealable shipping containers which additionally are collapsible for space saving, storage purposes.

BACKGROUND ART

The prior art is replete with shipping and storage containers, many of which are collapsible for one reason or another. For example, U.S. Pat. No. 3,344,831 to Brackett discloses a collapsible container which is supported on or attached to a carrier vehicle. The container has a portable base frame which is expandable automatically upon reception of liquid or grain to be shipped. The container walls are constructed from durable foldable material to ensure safe handling of the substance being shipped and are suitably attached to the base frame along with a pair of framed doors. The container is also sufficiently flexible to allow expansion or contraction without venting which reduces or eliminates spoilage and fume leakage. The collapsed device facilitates easy storage because of its reduced height, which may only be 20% of its expanded height. The collapsed container is also usable as a pallet in its collapsed position.

U.S. Pat. No. 3,840,135 to Bridge discloses a collapsible cargo container having a grill-like metal base, end walls pivoted to opposite ends of the base at different levels to be folded on top of the other and removable sidewalls carried on posts detachably connected to the base and lifted from the top by a harness and lift truck. The posts transfer the lifting loads to the base free from the sidewalls of the container. The side and end walls are in the form of an open framework having cords interlaced there across under tension. Plastic panels may be mounted inside the cords to protect the contents of the container from pilferage.

U.S. Pat. No. 4,557,400 to Clarke discloses a carrier unit that can be converted from a general cargo carrying unit to a bulk material carrying unit. In converting the unit to a bulk carrying unit, a flexible liner is removed from the hopper and pulled to extend the length of the unit's compartment to define a liner compartment for holding bulk materials. The flexible liner conforms to the shape of the compartment as such is defined by the walls, the ceiling and the vertical floor sections of the compartment, etc.

U.S. Pat. No. 3,980,196 to Paulyson et al, discloses a container utilizing a flexible liner bag for carrying bulk cargo such as grain. The liner bag can be formed as a seamless tube of polyethylene about six mils thick, squared and sealed at its ends to provide a 20 or 40 foot long, generally rectangular bag. The bag has two loading apertures through its upper rear wall. The bag is supported by an external support frame. To discharge or unload cargo from the bag, the bag is pierced and cut. The container holding the bag is then tilted to pour the cargo from the container.

U.S. Pat. No. 3,868,042 to Bodenheimer also discloses a container for the transportation of bulk cargo which includes a disposable container liner positioned within the container. The container also includes means for removing air from the container liner as the liner is being filled with bulk cargo.

U.S. Pat. Nos. 4,054,226 to Bjelland et al; and 3,616,957 to Patton also disclose various types of cargo shipping containers.

While the foregoing patents disclose various containers for the shipment of bulk cargo, some of which are collapsible and some of which utilize plastic liners, a need still exists for a flexible, collapsible container that does not require an extensive external support framework. A need also exists for a flexible, collapsible container which is sealable so that material can be transported and stored in the container under either a vacuum or a positively pressurized atmosphere. Such an atmosphere could be; for example, a gaseous nitrogen atmosphere which would be of value in shipping grain since nitrogen is a grain preservative.

DISCLOSURE OF THE INVENTION

The present invention addresses the aforementioned concerns by providing a collapsible module or container for the storage and transportation of matter, preferably bulk cargo, such as grain and plastic resins. The module includes a flexible, collapsible body defining a storage chamber for storing matter. The body also defines at least one port in communication with the storage chamber for conveying matter into and out of the chamber. The storage module further includes internal support means located in the storage chamber for preventing the body from rupturing when the storage chamber is filled with matter.

In a preferred embodiment of the invention, the flexible, collapsible body and port are sealable so that matter can be stored in the container under either a vacuum or a positively pressurized atmosphere. In addition, the internal support means includes a plurality of support lines or straps extending across the internal chamber wherein the ends of each support line or strap are attached to opposing inner surfaces of the body. As such, the plurality of support lines provides internal support for the body to prevent the body from rupturing when it is filled with matter.

In a particularly preferred embodiment of the invention, a first portion of the plurality of support lines is oriented to cross or overlap a second portion of the plurality of support lines and the crossing support lines are secured to each other at the locations where they cross each other to form a network of interconnected support lines. Such a network enhances internal support for the body, thereby enhancing the body's ability to resist rupturing when it is filled with matter.

The preferred embodiment of the present invention also includes a sealable discharge port in communication with the storage chamber of the body for discharging matter from the storage chamber. In addition, the preferred embodiment includes another sealable port in communication with the storage chamber for sealable connection to a vacuum means and/or a gas pressurization means. The flexible, collapsible body is preferably made from a flexible sheet of high strength, impact resistant plastic which is sufficiently flexible to collapse under the action of gravity when one of the ports in communication with the storage chamber is vented to the ambient atmosphere.

The present invention also provides a method for storing matter. The method includes providing a sealable, collapsible storage module having a flexible, collapsible body which defines a sealable storage chamber for shipping and storing matter. The body also defines at least one sealable port in communication with the storage chamber for filling the chamber with matter and/or discharging matter therefrom. The module also includes internal support means located in the storage chamber for preventing the body from rupturing when the storage chamber is filled with matter.

The method further includes the steps of raising the flexible body and filling the storage chamber with matter by feeding matter into the chamber through the sealable port. The port is sealed and air is then evacuated from the storage chamber so that pressure within the chamber is negative with respect to ambient pressure. The storage chamber is then pressurized with a desired gaseous atmosphere until the pressure is positive with respect to ambient pressure. Finally, the body is sealed to maintain the matter being stored in the chamber under the positively pressurized gaseous atmosphere.

BRIEF DESCRIPTION OF THE DRAWINGS

The invention will be more readily understood by reference to the accompanying drawings wherein like reference numerals indicate like elements throughout the drawing figures and in which:

FIG. 14 is an end view of the module of FIG. 1 showing the module of FIG. 1 loaded in a conventional shipping container.

FIG. 15 is an end view showing three collapsed modules of the type illustrated in FIG. 1 which are stacked in the conventional shipping container illustrated in FIG. 14.

FIG. 16 is a partial perspective view showing corner details of two of the stacked modules illustrated in FIG. 15.

FIG. 17 is a cross-sectional view taken along lines 17—17 of FIG. 16.

DETAILED DESCRIPTION OF THE PREFERRED EMBODIMENT

FIGS. 1 through 18 illustrate a shipping and storage module 10 of the present invention which is both sealable and collapsible. The module is sealable so that its contents can be shipped and stored under any desired gaseous atmosphere, such as nitrogen. Nitrogen is a preferred atmosphere for grain storage since it can preserve grain for as long as 12 months. Module 10 is also collapsible when it is empty. This enables many collapsed modules to be stored in a space that can hold only one filled module. This is obviously of advantage where space is at a premium and when the modules are returned for reuse.

Figure 18:
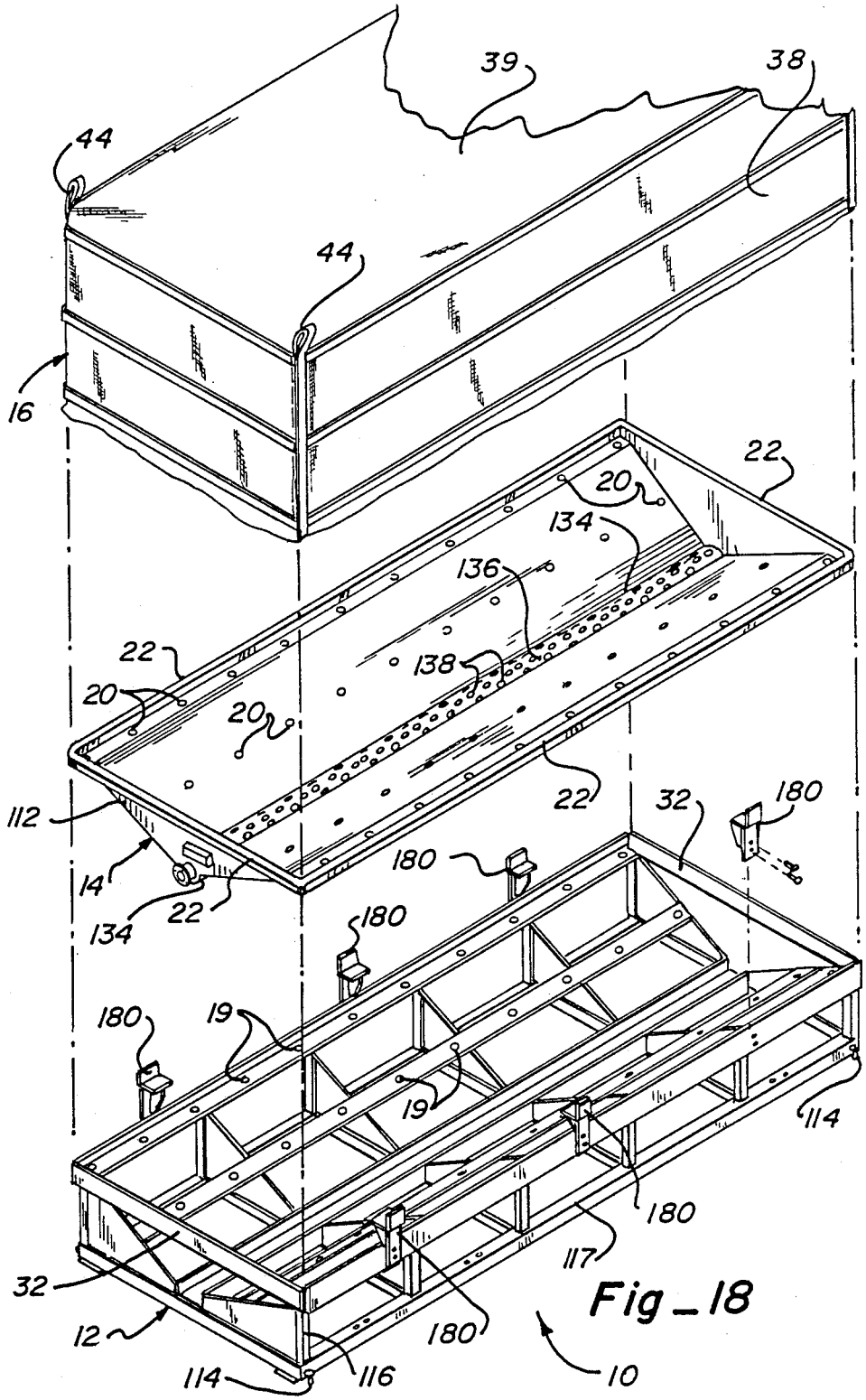
FIG. 18 is an exploded perspective view showing the three main components of the module of FIG. 1.

As best illustrated in the exploded view of FIG. 18, module 10 includes three main sections; a rigid support framework 12, a rigid V-shaped bottom tray portion 14 and a flexible, collapsible upper body portion or body 16 which is sealed to bottom tray portion 14 to provide a storage chamber 17 for storing and shipping matter such as grain.

Support framework 12 is preferably made from aluminum or an alloy thereof because aluminum's light weight and high strength is an advantage during shipping. Bottom tray portion 14 is preferably made from fiberglass because it is also relatively strong and light weight and easily made into the illustrated V-shape form. Upper flexible, collapsible body portion 16 is preferably made from a sheet of PVC impregnated woven, dacron polyester. This material is extremely strong and not easily ruptured or torn. It can be purchased from the Seaman Corporation of Wooster, Ohio.

Figure 7:
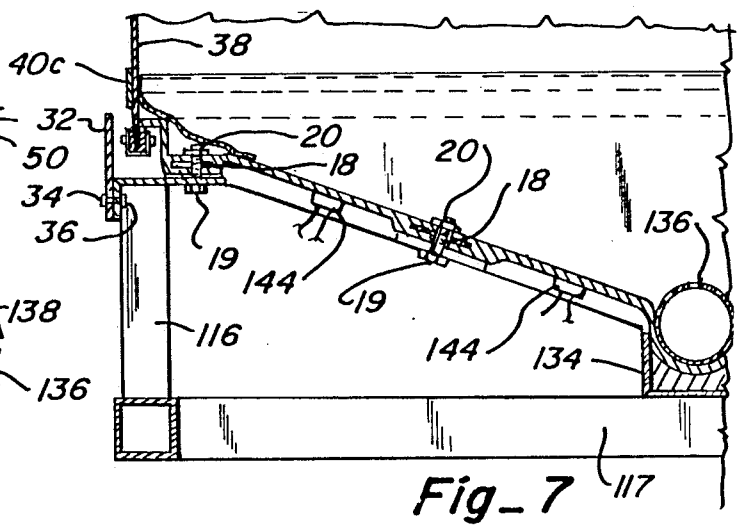
FIG. 7 is a cross-sectional view taken along lines 7—7 of FIG. 4.
Figure 5:
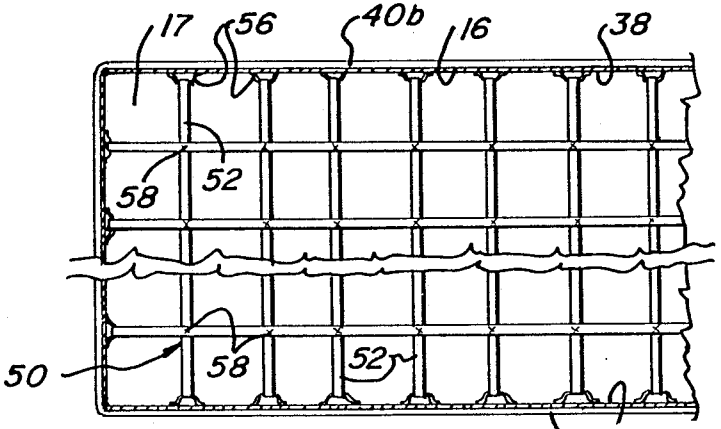
FIG. 5 is a cross-sectional view taken along lines 5—5 of FIG. 2 and 4.
Figure 4:
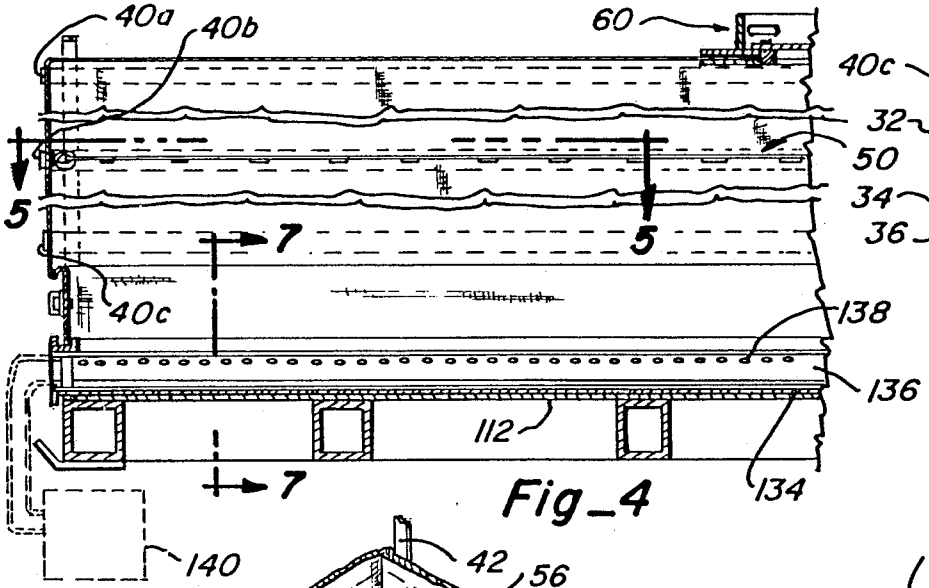
FIG. 4 is a cross-sectional view taken along lines 4—4 of FIG. 2.
Figure 6:
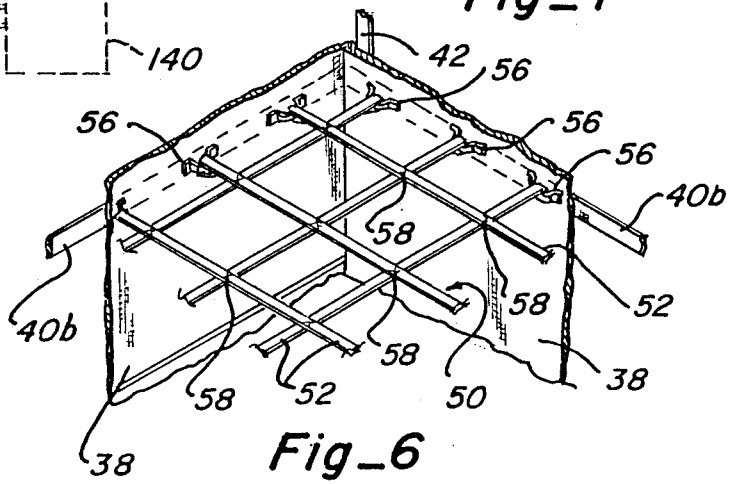
FIG. 6 is a partial perspective view taken from the inside of the module of FIG. 1 showing internal support straps for preventing the module from bursting when it is filled with matter.
Figure 12:
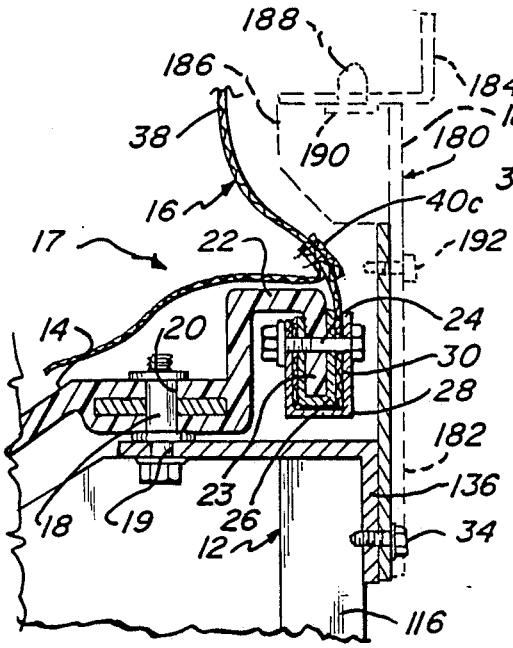
FIG. 12 is partial cross-sectional view of the module in FIG. 1 which additionally shows in phantom the stacking bracket of the present invention attached to the guard plate.
Figure 12:
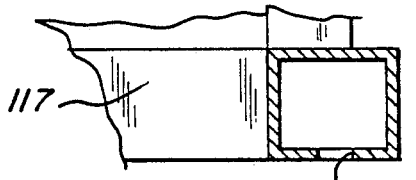

As best illustrated in FIGS. 7 and 12, bottom tray portion 14 is rigidly secured to support framework 12 by a plurality of conventional Rivnut assemblies 18. Rivnut is a registered trademark of the B.F. Goodrich Corporation of Akron, Ohio. Rivnut assemblies 18 secure tray portion 14 to support framework 12 by extending through corresponding holes 19 and 20 of framework 12 and tray bottom 14, respectively. The provision of holes 19 and 20 is best illustrated in FIG. 18.

FIG. 12 also illustrates a preferred means (not numbered) for sealing flexible upper portion 16 to bottom tray portion 14. The sealing means includes: (1) an inverted U-shaped or channel shaped portion 22 of tray bottom 14 having a downturned edge 23; (2) bolt means 24; (3) sealing gasket means 26 preferably made of a soft polyethylene gasket material; and (4) a rigid U-shaped or channel-shaped outer casing 28, preferably made of rigid material such as steel. The seal is provided by encasing downturned edge 23 with flexible gasket means 26. The bottom edge of upper body (which is identified herein by numeral 30) is then wrapped about gasket means 26. Outer casing 28 is then located over downturned edge 23 so that gasket 26 and edge 30 of upper portion 16 are sandwiched between casing 28 and edge 23. A hole (not numbered) is then drilled through the sandwiched members to enable bolt means 24 to be inserted through the hole and tightened to provide a tight seal. While not illustrated in the drawings, it is preferred that a bolt means 24 be provided about every 6 inches along channel 22. This will provide an extremely high integrity seal about the entire perimeter of the tray bottom. The preferred location of bolt means 24 at the corners of module 10 is illustrated in a break away view of FIG. 11.

Figure 11:
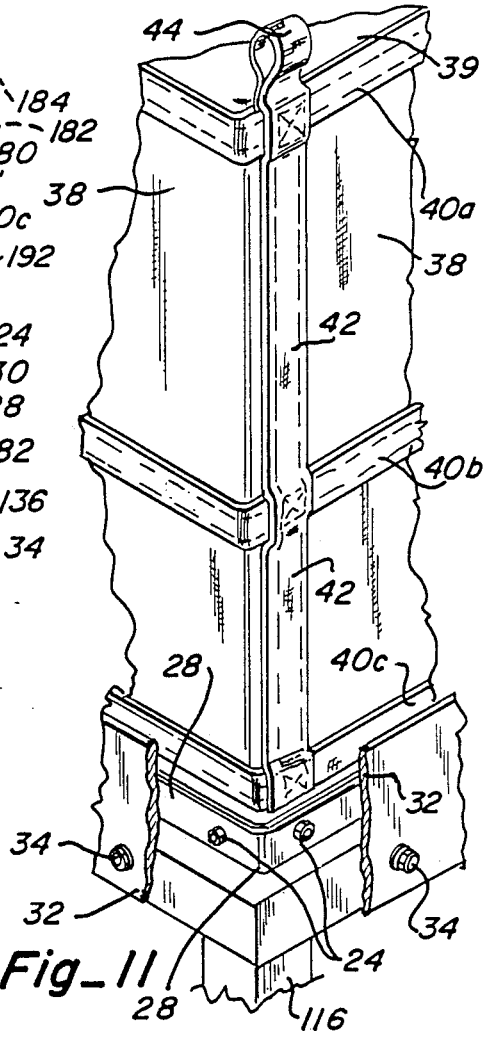
FIG. 11 is a partial perspective view showing corner details of the module of FIG. 1 with a portion of the view broken away to show corner details of the means for sealing the upper body portion to the tray bottom of the module.

FIGS. 11 and 12 illustrate the provision of a guard plate 32 which is secured by a bolt means 34 to a downwardly projecting flange portion 36 of support framework 12. Guard plate 32 serves to protect this area of module 10 where edge 30 of upper body portion 16 is sealed to tray bottom 14. Guard plate 32 may be removed by simply removing bolt means 34 if such is necessary for whatever purpose, for example, to repair the seal between the tray bottom and the flexible upper body portion.

Upper body portion 16, as illustrated in the figures, includes four sides 38 and a top portion 39. Top portion 39 is preferably integral with sides 38 as illustrated. However, it may be provided as a separate piece which is thermally bonded and/or stitched to sides 38 if such is desirable for ease of manufacturing. Whether one piece or two piece, however, body portion 16 should be capable of defining an air tight chamber 17 when it is sealed to tray bottom 14, as previously described.

FIGS. 1, 2, 8, 12 and 18 illustrate that flexible upper body portion 16 is supported on its outside surface by a series of woven nylon webbing side straps (identified respectively as top strap 48, middle strap **40*b* and bottom strap 40*c*, each of which extends, continuously, around all four sides 38 of upper body portion 16. The figures also illustrate that each corner (not numbered) formed by adjoining sides 38 is supported by a vertical side strap 42 which is similar to straps 40 and preferably made from the same material as straps 40. Each side strap 42 is stitched to straps 40 as illustrated in FIG. 12 where it crosses straps 40**.

FIG. 12 also illustrates that straps 40, 42 are stitched directly to sides 38. Straps 40, 42 are also preferably thermally bonded to each other and to sides 38 by conventional heat sealing techniques. Stitching and thermally bonding the straps to the flexible sheet material of the sides provides an extremely strong bond. As such, the straps significantly enhance the strength of upper body portion 16, thereby preventing upper body 16 from rupturing or bursting when it is filled with grain or other matter.

Figures 1, 2, 3:
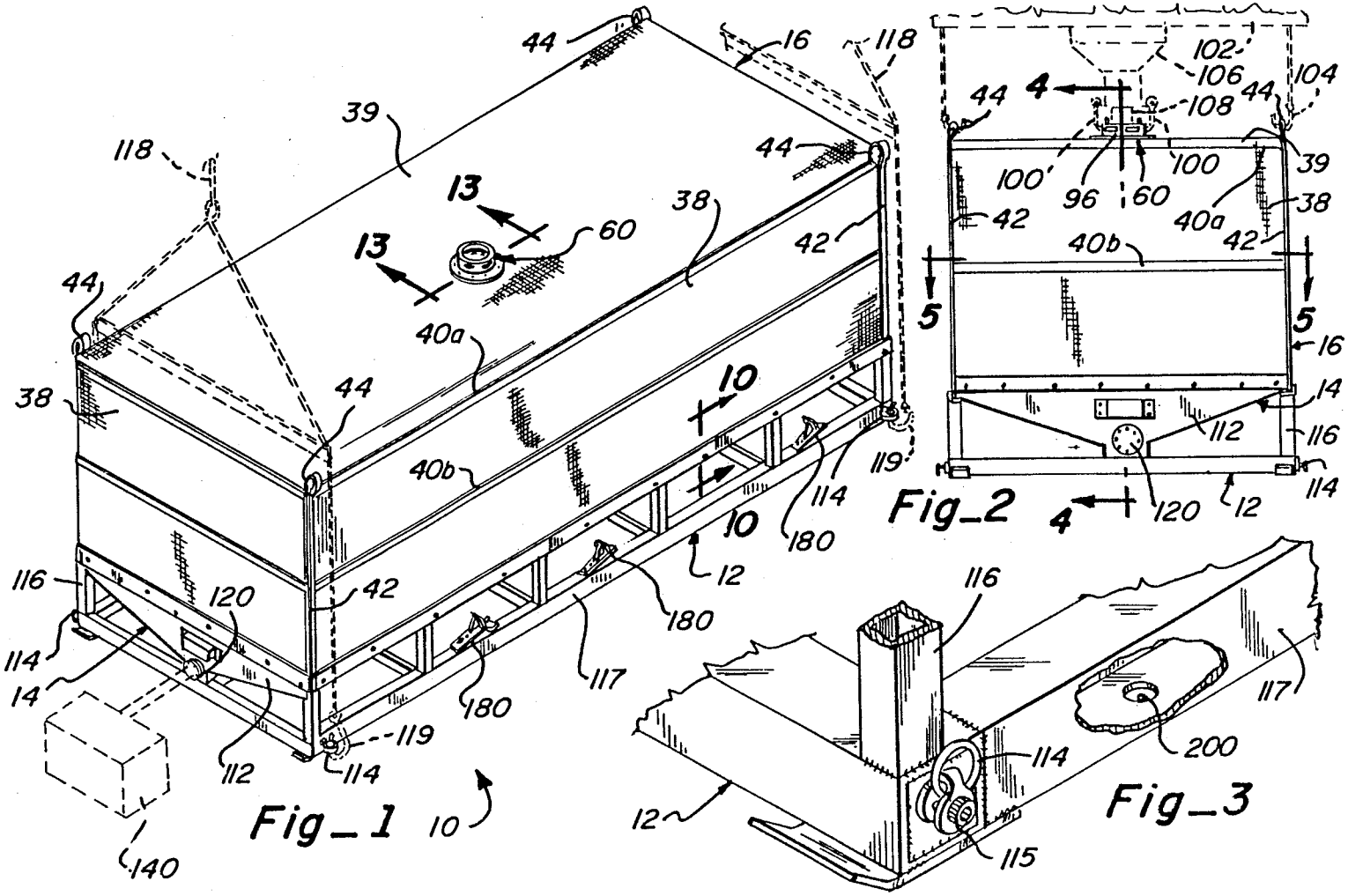
FIG. 1 is a perspective view showing a filled storage module of the present invention which additionally illustrates a hoisting means attached thereto in phantom for lifting filled the module during shipping.
FIG. 2 is an end view of the storage module of FIG. 1 which additionally illustrates a lifting means in phantom for raising the upper body portion of the module and a filling means in phantom for filling the module.
FIG. 3 is an enlarged perspective view showing corner details of the support framework of the module of FIG. 1 with a portion thereof cut away to show a bore for receiving a locating pin of another module stacked beneath the illustrated module during storage of empty modules.

FIG. 12 also illustrates that the upper end of each strap 42 is provided with a stitched loop 44. As such, a loop 44 is provided at each corner of upper body portion 16. With loops 44 so located, upper portion 16 can be raised, as such is illustrated in FIG. 2, when it is empty so that it can be filled with grain or any other desired granular or powdered material. The filling process will be described in more detail below.

Figure 8:
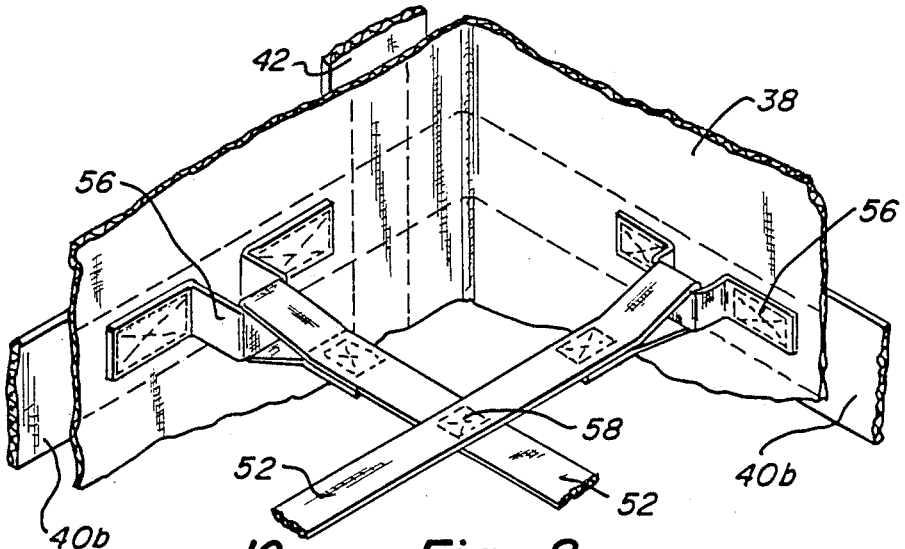
FIG. 8 is an enlarged perspective view similar to FIG. 6 showing in detail the anchor straps for securing the support straps to the sides of the module.

FIGS. 4, 5, 6 and 8 illustrate an important aspect of the present invention which is the provision of an internal support means or network 50 inside chamber 17 for preventing upper body portion 16 from rupturing when its chamber 17 is filled with grain or other matter. Internal support means 50 comprises a plurality of support lines or straps 52 (also preferably made of woven nylon webbing) which extend across chamber 17 from one side 38 of upper flexible body 16 to an opposing side 38. As best illustrated in FIG. 8, the ends of each strap 52 are folded over and stitched to an adjacent area of each strap 52 to form a loop 54. Each loop 54 is secured to its associated side 38 of upper body portion 16 by an anchor strap 56 (also preferably made of woven nylon webbing) which is stitched and preferably thermally bonded at its ends to side 38. Each anchor strap 56 is also, as illustrated, preferably located in the center area of side 38 opposite side strap **40*b* and the stitching securing each anchor strap to its side preferably extends through the side into side strap 40*b* to more securely attach the anchor strap to the side. With each anchor strap so secured, it is highly unlikely that anchor straps 56 will break loose or tear away from sides 38 when chamber 17 is filled with matter. Accordingly, support straps 52 and anchor straps 56 should prevent upper body portion 16 from rupturing when storage chamber 17 is filled with matter. Moreover, the strength provided by support straps 52 is believed to be further enhanced by stitching each strap 52 to the straps 52 it crosses, as illustrated. The locations where straps 52 cross each other are identified and referred to herein as crossings 58**.

FIGS. 1, 2, 4, and 13 in particular, illustrate a sealable filling port 60 of the present invention through which grain and other matter is conveyable. Port 60 is primarily intended to function as an inlet port for filling chamber 17 with matter. However, it can also be used as an outlet or discharge port for withdrawing matter from chamber 17 if such is desired. Port 60 generally includes a flange member 62 and a removable, sealing plug 64 which is capable of sealingly engaging with flange member 62 to provide an air tight seal. Flange member 62 is sealed to an edge portion 65 of upper body 16 which defines the hole (not numbered) in top portion 39 for receiving the flange member and sealing plug. The means for sealing flanqe member 62 to edge portion 65 includes (1) a plurality of upright threaded studs or bolts Which are welded about the perimeter of flange member 62; (2) a plurality of nuts 68 for threading onto the ends of studs 66; (3) first and second sealing ring gaskets 70 and 72; and (4) a rigid outer ring 74 preferably made of stainless steel. Edge portion 65 and rings 70–74 are also provided with a plurality of holes (not numbered) which are sized and located to align with each other to receive studs 66.

To seal flange member 62 to edge portion 65, sealing ring gasket 70 is first mounted on flange member 62 by inserting studs 66 into the holes of ring gasket 70. Studs 66 are then inserted through the holes of edge portion 65 so that edge portion 65 is overlying sealing ring gasket 70. Sealing ring gasket 72 is then mounted on flange member 62 so that gasket 72 overlies edge portion 65 with studs 66 located in gasket 72's holes. Rigid outer ring 74 is then mounted on flange-like member 62 in a similar manner so that studs 66 extend through its holes. Nuts 68 are then threaded onto studs 66 and tightened to sandwich the aforementioned members tightly together to provide an air tight seal of high integrity.

Flange-like member 62 also has a cylindrical portion 76 defining a passageway 78 in communication with chamber 17. Sealing plug 64 is capable of sealingly engaging with the walls of cylindrical portion 76 to provide an air tight seal across passage way 78, thereby sealing chamber 17 from the ambient atmosphere.

Sealing plug 64 includes a base plate 80 defining a central hole 82, a threaded handle 84, a threaded bolt 86 having a cap 88 secured to one of its ends and a compressible sealing ring 90, preferably made from a compressible polyurethane material. Two eye bolts 91 are also provided which are pivotally mounted to flange member 62 on opposite sides of hole 82. Each eye bolt 91 is mounted to flange member 62 by a pivot pin 92 which extends through the eyelet of the eye bolt and which is rigidly secured to a block 93 welded to flange member 62. Each eye bolt 91 is also provided with a wing nut 94 for tightening up against base plate 80 as will be explained below.

Figure 13:
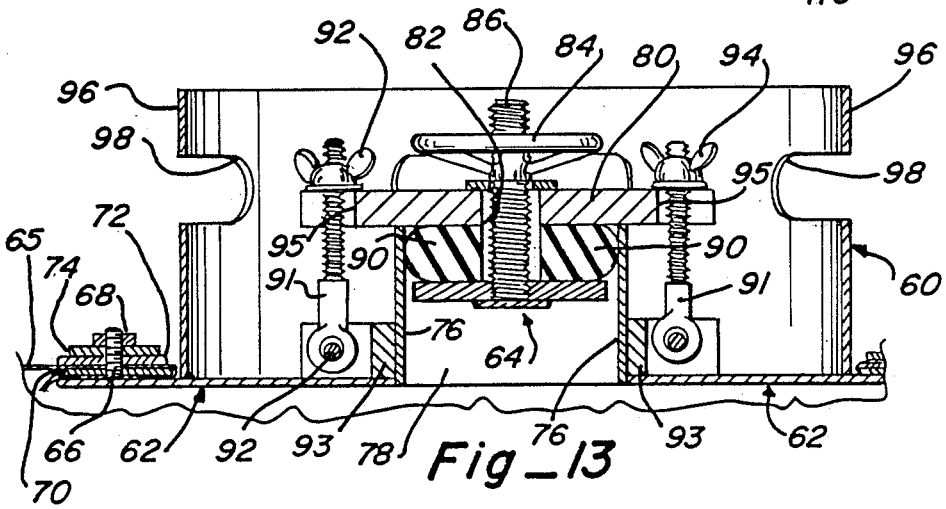
FIG. 13 is a cross-sectional view taken along lines 13—13 of FIG. 1.

To assemble sealing plug 64, the free end of bolt 86 is inserted through the hole of compressible sealing ring 90 and then through hole 82 of base plate 80. Threaded handle 84 is then threaded onto the free end of bolt 86 until compressible ring 90 is sandwiched between base plate 80 and cap 88. Sealing plug 64 is now ready to be sealed to the inner walls of tubular portion 76 to seal passageway 78. Such is provided by inserting sealing plug 64 into passageway 78 until base plate 80 is located flush against the exposed ends of tubular portion 76. Eye bolts 91 are then pivoted into grooves or slots 95 provided in base plate 80. Wing nuts 94 are then threaded on eye bolts 91 until they tighten up against base plate 80. This secures base plate 80 up against the exposed ends of tubular portion 76. Handle 84 of sealing cap 64 is then tightened to compress compressible ring 90 up against the walls of cylindrical portion 76 as such is illustrated in FIG. 13. As such, passageway 78 is sealed, thereby sealing chamber 17 from the ambient atmosphere.

To remove sealing plug 64 from passageway 78, wing nuts 94 are loosened to enable eye bolts 91 to be removed from slots 95 provided in base plate 80. Handle 84 is then unthreaded which decompresses compressible ring 90. As such, compressible ring 90 assumes a more spherical shape, and shrinks away from the walls of cylindrical portion 78 thereby allowing sealing plug 64 to be removed from passageway 78.

FIG. 13 also illustrates that flange member 62 has a guard and lifting ring 96 attached to it, preferably by welding. Ring 96 serves to protect port 60 from being accidentally damaged by contact with other objects. Ring 96 is also provided with ports 98 for receiving hooks 100 of a hoisting or lifting means 102 illustrated in phantom in FIG. 2. Lifting means 102 also includes, as illustrated in FIG. 2, hooks 104 for attachment to loops 44. Hooks 100 and 104 enable lifting means 102 to lift upper body portion 16 so that chamber 17 can be filled with grain or other matter. FIG. 2 also illustrates, in phantom, a conventional hopper means 106 having a lower end 108 located in passageway 78 for filling chamber 17 with matter.

After chamber 17 is filled with its desired contents, port 60 is sealed with sealing plug 64 as previously described. If chamber 17 is filled with grain, chamber 17 is preferably evacuated to about $-2$ psi and then filled with dry nitrogen to about $+3$ to $+5$ psi. As previously mentioned, nitrogen gas is a low cost preservative for grain which enables grain to be stored for as long as 12 months.

Figure 9:
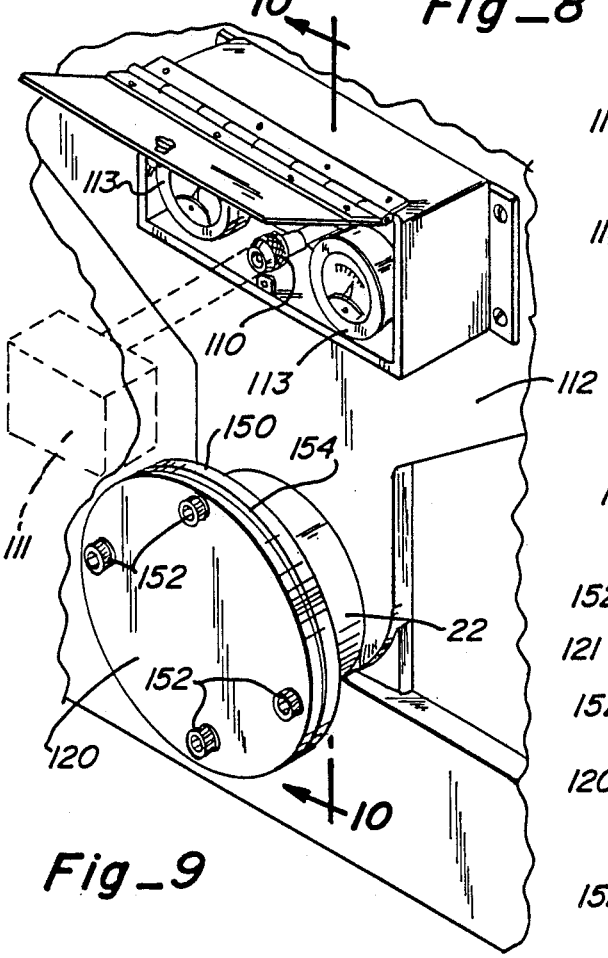
FIG. 9 is a partial perspective view of the module of FIG. 1 showing the discharge port, quick disconnect coupling and pressure gages in detail.

Chamber 17 can be evacuated by connecting chamber 17 via a quick disconnect coupling 110 to a source 111 of vacuum as such is illustrated in FIG. 9. This is provided by mounting coupling 110 in a front sidewall 112 of tray bottom 14. Conventional gauges 113 are also mounted in sidewall 112 in communication with chamber 17 for monitoring the pressure within chamber 17. This enables one to disconnect the vacuum source from disconnect coupling 110 as soon as the desired pressure is reached.

Disconnect coupling 110 is provided with conventional valving apparatus so that the desired vacuum in chamber 17 will be maintained when vacuum source 111 is disconnected from coupling 110. A vacuum source containing a pressure regulator may also be used which will shut off automatically when the desired vacuum is reached. This type of vacuum source would be desireable where the porosity of the matter in chamber 17 is such that is will take quite a while to evacuate chamber 17 as desired.

Chamber 17 can also be pressurized with nitrogen gas or another desired gas by using quick disconnect coupling 110 and gages 113. This simply involves connecting chamber 17 to a source 111 of the desired gas instead of the previously mentioned vacuum source. The gas is then pumped into chamber 17 until gauges 113 indicate that chamber 17 is pressurized with the desired amount of gas. The gas source is then disconnected from coupling 110 which is also provided with conventional valving apparatus for maintaining the desired pressurized atmosphere within chamber 17, i.e., it is provided with conventional valving to prevent the back flow or escape of gas through coupling 110. As with the vacuum source, the means for pumping gas into chamber 17 could be provided with a pressure regulator that will shut off as soon as the desired pressure is reached within chamber 17. The time required to fill chamber 17 again would depend on the porosity of the matter stored in chamber 17.

After filling and pressurizing, module 10 will normally be shipped to the end user. This will most undoubtedly necessitate that module 10 be lifted. To facilitate the lifting of module 10, FIGS. 1, 2, and 3, in particular, illustrate that module 10 is provided with a lift support means which includes four hoist rings 114 having threaded bolt means 115. Hoist rings 114 are rigidly secured to the support framework 12 of module 10 by threading the rings' bolt means 115 into threaded bores (not numbered) which are provided in the vertical corner support braces 116 of support framework 12. Since each vertical corner brace 116 is, as illustrated in FIG. 2, welded to horizontal support members 117 of framework 12, an extremely strong lift support means is provided. Other lift support means could also be employed; however, such a means must be strong enough to withstand the weight of a fully loaded module which can be extremely heavy. For example, a module loaded with grain and having dimensions of 7'-6"×19'-0"×6'-0" can weigh as much as 35,000 pounds. Hoist rings which are suitable for use on module 10 of the present invention can be purchased from the Jergens, Inc. of Cleveland, Ohio.

FIG. 1 illustrates that the lift support means of the present invention, i.e., hoist rings 114, is easily attached to a conventional hoisting means 118 which is illustrated in phantom in FIG. 1. Such merely requires the insertion of a hoist hook 119 into each of the hoist rings 114.

When storage module 10 reaches its final destination, grain or other matter stored therein is discharged or withdrawn from chamber 17 by removing a sealing cap 120 from a discharge port 121 and then drawing the matter from chamber 17 out through discharge port 121 which is in communication with chamber 17. Discharge port 121 is defined by a tubular portion 122 which projects outwardly from sidewall 112 of tray bottom 14. In FIG. 18, it can be seen that tubular portion 122 is located in sidewall 112 so that discharge port 121 opens into a trough 134 also defined by tray bottom 14.

Figure 10:
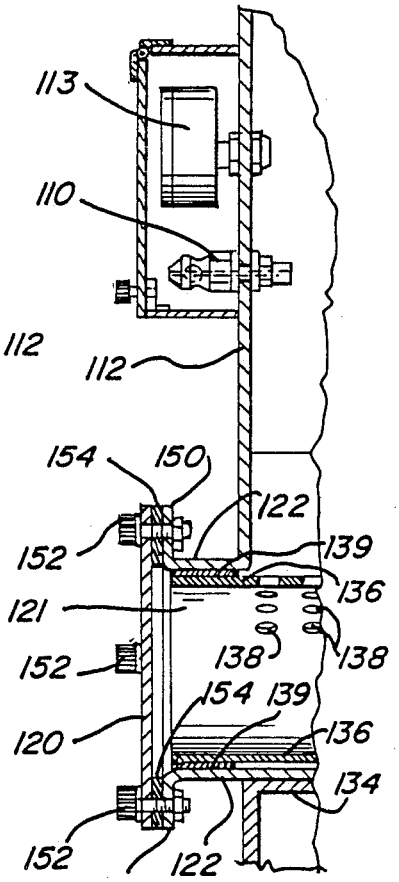
FIG. 10 is a cross-sectional view taken along lines 10—10 of FIG. 9.

FIG. 18 also illustrates that a perforated discharge tube 136 having perforations 138 is located in trough 134. Perforations 138 are sized to permit the easy passage of whatever matter is stored in chamber 17. FIG. 10 illustrates that an end of perforated tube 136 is sealed to the walls of tubular portion 122 by a wedge shaped removable sealing ring 139. As such, when tube 136 is connected to a vacuum source 140 (illustrated in phantom in FIG. 4) grain or other matter in chamber 17 will be drawn into tube 136 through perforations 138. The matter is then drawn through tube 136 and conveyed out of chamber 17 to a suitable bin (not shown) or storage means for collecting the matter withdrawn from chamber 17.

A suitable vacuum means for drawing matter out of chamber 17 includes a conventional compressor or compressed air supply system which is connectable to a tool sold under the trademark "Vacutrans" by the Inventive Machine Corporation of Bolivar, Ohio. The Vacutrans tool converts a conventional compressor into a vacuum and material transferring system which is very effective in withdrawing matter from containers such as module 10.

Module 10 is also preferably provided with vibrating means such as electric transducers 144 which are connected to the bottom surface of tray bottom 14. When activated, transducers 144 vibrate tray bottom 14 to prevent perforations 138 from unclogging with grain or whatever matter is stored in chamber 17.

While the illustrated embodiment utilizing perforated discharge tube 136 is a preferred means for withdrawing matter from chamber 17, any suitable means for withdrawing or discharging matter from chamber 17 is considered to be within the scope and spirit of the present invention. Other discharge means which could be utilized and may, in fact, be preferable depending on the application, include means such as a screw-type auger means which would also be located in trough 134.

After withdrawing all matter from chamber 17, it will generally be desirable to seal discharge port 121 so that chamber 17 can again be filled with matter. FIG. 10 illustrates that discharge port 121 is made sealable by providing the free end of tubular portion 122 with a flange portion 150. Flange portion 150 is provided with four bolt holes (not numbered) for receiving four bolts 152 to secure cap 120 having a sealing ring gasket 154 to flange portion 150. Cap 120 and ring gasket 154 will tightly seal discharge port 121 when bolts 152 are properly tightened.

An important feature of module 10, as previously alluded to, is the ability of upper body portion 16 to collapse when chamber 17 is emptied of its contents. Such collapsibility is provided in accordance with the present invention by making upper body portion 16 from a sheet of the previously described PVC impregnated Dacron or any other tough material which is flexible enough to collapse under the action of gravity. The collapsibility of upper body portion 16 is an extremely important aspect of the present invention since it enables the collapsed, empty module 10 to occupy much less space and thus be stored in a much smaller space than it could be if it were not collapsible. As such, it is expected that module 10 will find widespread use on trucks and ocean going vessels where storage space for the return of empty containers is limited.

The collapsibility of upper body portion 16 is best illustrated in comparing FIG. 14 with FIG. 15. In FIG. 14, module 10 is completely filled with matter so that it almost completely occupies a conventional 8'-0" by 8'-0" by 20'-0" shipping container 170 which is typically used for ocean shipping. FIG. 15 illustrates that container 170 can hold three empty and collapsed, stacked modules, thereby freeing two containers 170 for other uses.

The means for stacking collapsed modules 10 is best illustrated in FIGS. 15 through 18 wherein it can be seen that six stacking brackets 180 are employed for stacking one collapsed module 10 on top of another collapsible module 10. Each stacking bracket 180 includes a vertical plate 182, an angled portion 184 welded to an end of vertical plate 182 and a right angled support bracket 186 welded to both vertical plate 182 and angled portion 184 to prevent angled portion 184 from bending when it's supporting a module. It can also been seen that vertical plate 182 is provided with two bores (not numbered) for receiving bolt means to secure it to support frame 12. In addition, angled portion 184 is provided with a locating pin 188 having a pin head 190. Locating pin 188 is rigidly affixed to angled portion 185 by inserting it through a bore (not numbered) in angled portion 184 and then welding its pin head 190 to angled portion 184.

To attach stacking bracket 180 to frame 12, bolt means 34 is unthreaded from support frame 12 so that guard plate 32 can be removed from support frame 12. Guard plate 32 and vertical plate 182 of stacking bracket 180 are then aligned with each other so that each's respective pair of bores is aligned with the other's. A bolt means 192 is then threaded into the pair of aligned bores located closest to angled portion 184. Bolt means 192 is then tightened to secure guard plate 32 and stacking bracket 180 together. The attached guard plate 32 and stacking bracket 180 are then tightly secured to frame 12 by threading bolt means 34 into the other aligned pair of bores and into the bore provided in frame 12.

FIG. 18 illustrates that each module 10 is provided with six stacking brackets 180, three along each lengthwise extending side of module 10. Six brackets should provide more than ample support for stacking the three collapsed modules illustrated in FIG. 15.

FIGS. 3, 12 and 17 illustrate that the bottom of structural member 117 of support frame 12 is provided with a bore 200. Six bores 200 are actually provided along the bottom portion of each module, one for each stacking bracket 180. Bores 200 are sized and configured and spaced from each other along the bottom of the module to receive the locating pins 188 of the module located beneath it. Locating pins 188 serve to insure that the modules are properly stacked upon each other and they help prevent the stacked modules from sliding off one another which could be caused by a sudden movement of the ship or truck carrying the modules.

From the foregoing description it will be readily apparent the storage module of the present invention provides a number of advantages. For example, the storage module's sealability enables grain and other matter including chemical resins to be stored in the module under either a vacuum or a positively pressurized atmosphere such as nitrogen. Since vacuum and pressurized storage will preserve most matter which is stored in the chamber, matter can be stored in the module for extremely long periods of time. This makes the module particularly desirable for the shipment of grain on ocean going vessels. At the present, grain is typically shipped in unsealed shipping containers such as container 170 or in the open holds of ships. By the time the grain reaches its final destination, much of it may already be spoiled. This is particularly a problem where the final destination is a remote inland site in a third world country. Such grain is typically dumped onto the shipping yard of the third world country's seaport. The grain is then loaded into trucks for transportation to the remote site. Since such journeys are often quite long, the grain is often spoiled by the time it reaches the end user.

The storage module of the present invention completely solves this problem by enabling grain to be shipped and stored in a nitrogen atmosphere which is capable of preserving the grain for many months.

This invention has been described in detail with reference to a particular embodiment thereof, but it will be understood that various other modifications can be effected within the spirit and scope of this invention.

What is claimed:

1. A sealable collapsible storage module comprising:

a body having a rigid bottom portion and a collapsible upper portion, said collapsible upper portion being made from a sheet of flexible material, said upper portion also being sealably attached to said bottom portion so as to define a sealable storage chamber for storing of matter, said body also defining at least one sealable port in communication with said storage chamber through which said matter is conveyable, said sheet of flexible material being sufficiently flexible to enable said collapsible upper portion to collapse under the action of gravity when said port is vented to ambient atmosphere; and a plurality of generally horizontally disposed internal support lines extending across said internal chamber wherein each support line has opposite ends which are attached to opposing surfaces of said flexible upper portion, said plurality of support lines providing internal support for said flexible upper portion to prevent said upper portion from rupturing when said storage chamber of said body is filled with matter.

2. A collapsible storage module as claimed in claim 1 wherein said support lines cross each other at regular intervals and are secured to each other at the crossings to form a network of generally horizontal interconnected support lines.

3. A collapsible storage module as claimed in claim 1 wherein said storage chamber has a capacity greater than 5,000 gallons.

4. A collapsible storage module as claimed in claim 3 wherein said bottom portion is made from fiberglass.

5. A collapsible storage module as claimed in claim 1 wherein said sheet comprises a single-ply of flexible material.

6. A collapsible storage module as claimed in claim 5 wherein said sheet is a vinyl impregnated Dacron.

7. A collapsible storage module as claimed in claim 1 wherein said body further defines a second sealable port in communication with said storage chamber for sealable connection to a vacuum means for evacuating air from said storage chamber.

8. A collapsible storage module as claimed in claim 7 wherein second sealable port is connectable to a source of pressurized gas for pressurizing said storage chamber with said gas.

9. A collapsible storage module as claimed in claim 1 wherein said bottom portion defines a sealable matter discharge port in communication with said storage chamber.

10. A collapsible storage module as claimed in claim 9 further comprising discharge means mounted in said storage chamber on said bottom portion of said body, said discharge means further being located adjacent said discharge port and cooperating therewith so that matter can be conveyed by said discharge means from said storage chamber through said discharge port.

11. A collapsible storage module as claimed in claim 1 further comprising a rigid support framework for attachment to said bottom portion of said body.

12. A collapsible storage module as claimed in claim 1 further comprising means for stacking a plurality of said modules.

13. A method for storing matter comprising the steps of:

providing a sealable, collapsible storage module having a collapsible body defining a storage chamber for storing matter, said body being made from a sheet of flexible material, said body also defining at least one sealable port in communication with the storage chamber, said sheet of flexible material being sufficiently flexible to enable said body to collapse under the action of gravity when said port is vented to ambient atmosphere, said module also including generally horizontally disposed internal support means for preventing said body from rupturing when said storage chamber of said body is filled with matter;

raising the collapsible body so that matter can be fed into said storage chamber;

filling said storage chamber with matter by feeding matter into said storage chamber through said sealable port;

evacuating air from said storage chamber so that pressure within said chamber is negative with respect to ambient pressure;

pressurizing said storage chamber with a desired gaseous atmosphere until the pressure within said chamber is positive with respect to ambient pressure; and sealing said body to maintain the matter stored in said chamber under the positively pressurized gaseous atmosphere.

* * * * *